United States Patent [19]

Higgins

[11] Patent Number: 5,056,187

[45] Date of Patent: Oct. 15, 1991

[54] EAVE TROUGH CLEANING APPARATUS

[76] Inventor: Wayne A. Higgins, 1527 Southridge Rd., New Ulm, Minn. 56073

[21] Appl. No.: 575,643

[22] Filed: Aug. 31, 1990

[51] Int. Cl.[5] ..... A47L 9/02

[52] U.S. Cl. ..... 15/339; 15/415.1; 15/420; 15/236.04

[58] Field of Search ..... 15/339, 414, 415.1, 15/420, 236.04, 410; 134/167 C; 433/31; 248/476

[56] References Cited

U.S. PATENT DOCUMENTS

| | | | |
|---|---|---|---|
| 1,054,488 | 2/1913 | Bailey | 433/31 |
| 2,574,217 | 11/1951 | Lundgren | 433/31 |
| 2,862,299 | 12/1958 | Reiter | 248/476 |
| 3,023,971 | 3/1962 | Milhous | 239/532 |
| 3,040,626 | 6/1962 | Griffioen | 248/476 |
| 3,041,655 | 7/1962 | Entler | 15/600 |
| 3,777,756 | 12/1973 | Lohr | 433/31 |
| 3,971,098 | 7/1976 | Davis | 15/415.1 |
| 4,121,320 | 10/1978 | Feiner | 15/406 |
| 4,310,940 | 1/1982 | Moore | 15/105 |
| 4,319,851 | 3/1982 | Arthur | 134/167 C |
| 4,363,335 | 12/1982 | Tapper | 134/167 C |
| 4,402,106 | 9/1983 | Mattson | 15/406 |
| 4,570,286 | 2/1986 | Ross | 15/327 C |
| 4,870,714 | 10/1989 | Miner | 15/327 C |

FOREIGN PATENT DOCUMENTS

| | | | |
|---|---|---|---|
| 181694 | 5/1986 | European Pat. Off. | 15/414 |
| 625454 | 6/1949 | United Kingdom | 433/31 |

*Primary Examiner*—Philip R. Coe
*Assistant Examiner*—Terrence R. Till
*Attorney, Agent, or Firm*—Schroeder & Siegfried

[57] ABSTRACT

An attachment for a vacuum system which is utilized for cleaning the eave troughs of a building from ground level. The attachment is an arcuately-shaped at least semi-rigid tubular member which connects to an elongated at least semi-rigid extension tube of a vacuum system. The curvature and dimensions of the arcuate attachment allows the operator of the vacuum system to raise the arcuate attachment up to the eave trough and insert the free end thereof into the trough for purposes of cleaning the same. A mirror is mounted on the intrados surface of the arcuate attachment, which allows the operator standing on the ground to view the inner bottom surface of the trough which is being cleaned. The operator of the cleaning system can move the attachment through the length of the eave trough and suck all of the debris therefrom, while watching to ensure that no debris is left behind. The free end of the attachment tapers to a smaller diameter to facilitate mounting of other attachments thereto. Moreover, the free end of the attachment has a plurality of axial slits which prevent clogging thereof.

19 Claims, 3 Drawing Sheets

EAVE TROUGH CLEANING APPARATUS

DESCRIPTION

BACKGROUND OF THE INVENTION

The invention disclosed and claimed herein is related generally to improvements in cleaning debris from the eave troughs of a building. More particularly, this invention is directed toward an apparatus which can be used in conjunction with a vacuum system for cleaning the eave troughs of a home or other building while standing at ground level.

The eave troughs of a building commonly accumulate large amounts of debris from the surrounding trees, etc. When this accumulation becomes excessive, the eave troughs become clogged and will no longer properly drain the rainwater from the roof of the building. Consequently, it is desirous to clean the eave troughs occasionally to prevent such clogging from occurring.

The most typical method of cleaning the eave troughs of a building is for a person to climb upon the roof itself, or upon a ladder, and manually pick the debris out of the trough. The mere fact that the person must climb to an elevated position, to engage in such manual cleaning, creates an inherently dangerous condition. In view of such danger, cleaning systems have been developed which facilitate the cleaning of such eave troughs from ground level.

Most conventional devices which faciliate such cleaning from ground level operate on a basis of blowing or blasting the debris out of the eave troughs with a jet stream of air or water. Although such systems have been relatively effective, the debris which is blown from an eave trough either falls to the ground and must subsequently be cleaned up, or is blown back on top of the roof where a subsequent rainfall will cause such debris to once again accumulate in the eave trough. Another problem associated with such conventional devices is that it is very difficult to see the results of the cleaning operation from ground level. The person cleaning an eave trough from ground level cannot see whether all of the debris in the eave trough has been dislodged and removed therefrom.

It is evident, therefore, that there is a distinct need for an apparatus which can be used for cleaning the eave troughs of a building from ground level which does not require subsequent cleaning cf the yard therebelow, or the roof thereabove. It is also evident that it would be advantageous to provide a means by which the person cleaning the eave trough could readily view that portion of the trough which has just been cleaned to ensure that no unwanted debris is left behind. Each of these objects described above are provided with my new eave trough cleaning apparatus, as described hereinbelow.

BRIEF SUMMARY OF THE INVENTION

The present invention comprises an arcuately-shaped tubular attachment for use in conjunction with a vacuuming system which will suck the debris from the eave trough without creating any mess. The preferred vacuuming system to be used is a combinational wet/dry vacuum which is capable of drawing wet or dry leaves, sand and other debris from the eave troughs without causing damage thereto. The vacuum system must also include an elongated and at least semi-rigid tubular member which the operator can grip and hold in an upright manner so that it extends upwardly toward the eave trough which is to be cleaned.

The arcuately-shaped attachment mentioned above is comprised of a tubular member which is made of an at least semi-rigid material, such as plastic. The arcuately-shaped attachment is designed to cooperatively and telescopically connect to the free end of the elongated tubular extension member which extends from the vacuum system. The arcuately-shaped attachment becomes the terminal end portion of the elongated tubular extension member when attached thereto.

The attachment has a curvature and is dimensioned so as to facilitate positioning of its free end adjacent the inner bottom surface of the eave trough which is to be cleaned. When properly positioned, the arcuate attachment will extend up and over the outer edge of the eave trough being cleaned, where it connects to the end of the elongated extension member from the vacuuming system.

For the operator's viewing, a mirror is mounted on the intrados surface of the arcuately-shaped attachment to reflect the bottom surface of the eave trough which has just been cleaned. The attachment is constructed such that, when in use, there is sufficient clearance between the outer edge of the eave trough and the intrados surface of the arcuately-shaped attachment so as to provide adequate room for the mounting and usage of the mirror.

The free end of the arcuate attachment is preferably constructed with axial slits therein to prevent clogging of the vacuuming system with excessive or potentially larger debris which may be contained in the eave trough. The free end of the arcuately-shaped attachment also tapers to a smaller diameter to facilitate the telescopic mounting of additional attachments which may be helpful in freeing debris which is lodged in the eave trough.

With the use of my new attachment and cleaning apparatus for eave troughs, the operator may easily clean the eave troughs of a building without blowing the debris contained therein onto the ground or adjacent roof. The operator can effectively suck all of the debris out of the eave trough into the vacuuming system and easily view the portion of the trough which has just been cleaned to ensure that no debris is left therein.

The numerous advantages of the present invention will become even more apparent from the following detailed description and accompanying drawings.

BRIEF DESCRIPTION OF THE DRAWINGS

These and other objects and advantages of the invention will more fully appear from the following description, made in characters refer to the same or similar parts throughout the several views, and in which.

DETAILED DESCRIPTION OF THE INVENTION

Figure 1:
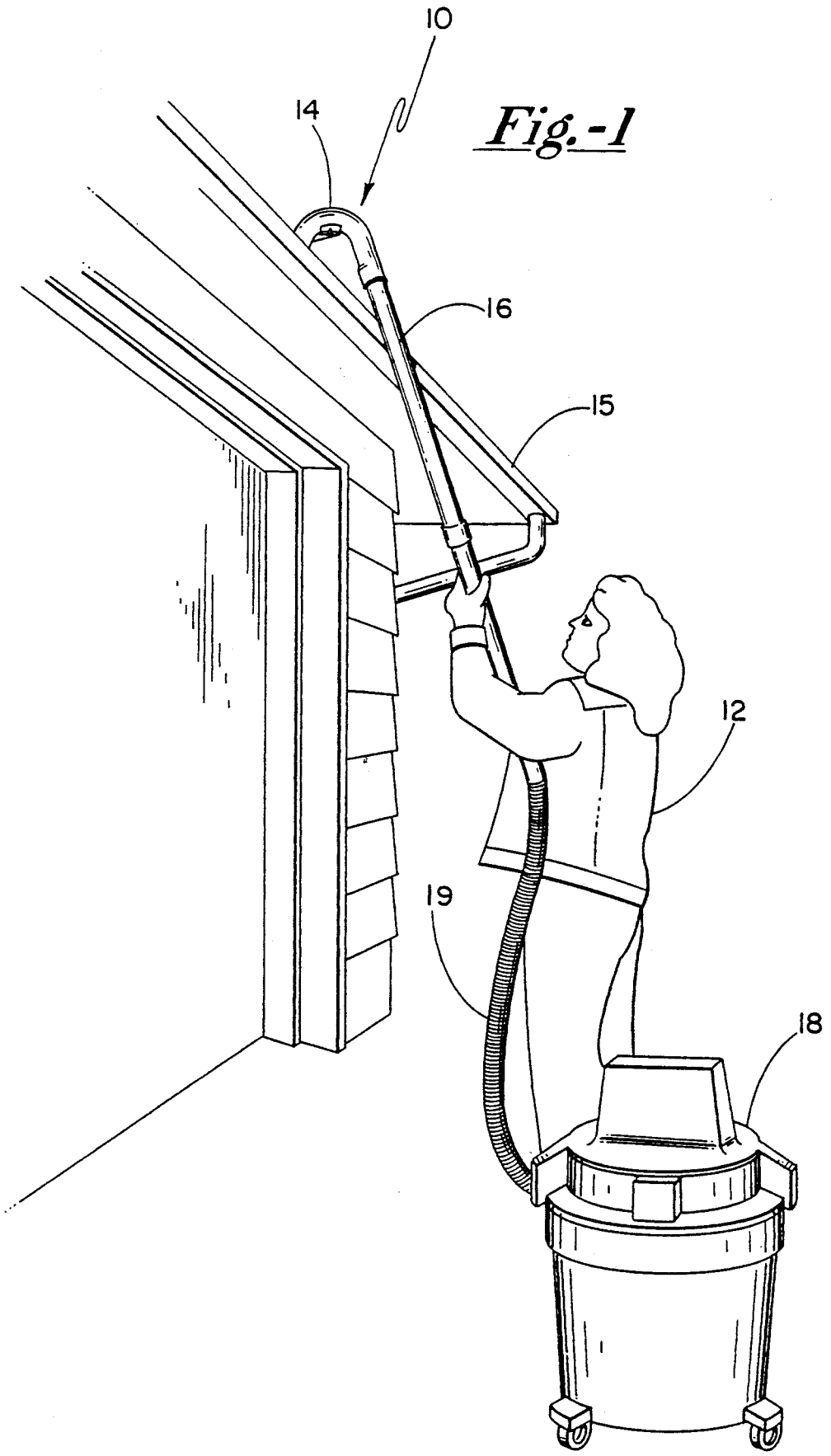
FIG. 1 shows my new eave trough cleaning apparatus being used in connection with a combined wet/dry vacuum and being operated by a homeowner who is cleaning the eave trough of a house.

As shown in FIG. 1, the present invention basically comprises a cleaning apparatus 10 for eave troughs 15 which can be operated by a homeowner 12 from ground level. More specifically, my eave trough cleaning apparatus 10 comprises an arcuately-shaped tubular attachment 14 which is telescopically mountable onto an elongated tubular extension member 16 which is connected to a suction or vacuuming system 18. The vacuuming system 18 is preferably a combinational wet/dry vacuum which is capable of drawing wet or dry leaves, sand and other debris from an eave trough 15 without causing damage thereto. The elongated extension member 16 upon which the arcuately-shaped tubular attachment 14 is mounted is connected to the combinational wet/dry vacuuming system 18 via a flexible hose 19.

The elongated extension member 16 and the arcuately-shaped tubular attachment 14 which connects thereto are preferably made from an at least semi-rigid material, such as polyethylene or other suitable plastic material. As used hereinafter and in the appended claims, the phrase "at least semi-rigid" is intended to mean a structure which is made from a material sufficiently rigid such that an elongated tubular member made from such material will be capable of withstanding the force of its own weight without substantial deformation or breakage when the entire tubular member is lifted from one end thereof.

Figure 2:
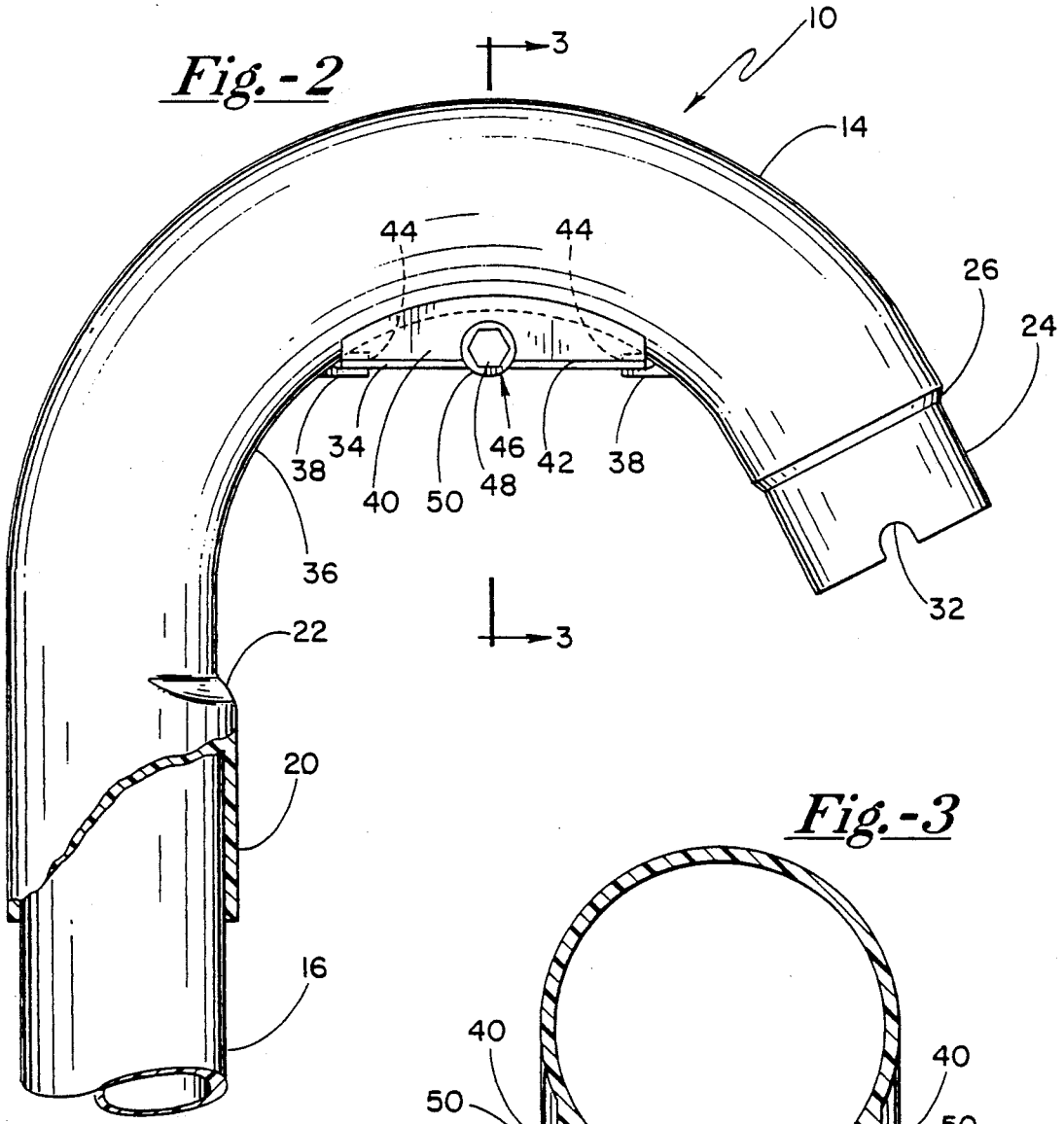
FIG. 2 is a side elevational view of my new eave trough cleaning apparatus, a portion thereof being broken away to show its telescopic engagement with an elongated extension member.

As best shown in FIG. 2, the arcuately-shaped tubular attachment 14 attaches to the elongated extension member 16 at end 20. End portion 20 is constructed with an inner diameter only slightly larger than the external diameter of tubular extension member 16, so as to facilitate cooperative but tight telescopic engagement of attachment 14 onto the free end of extension member 16. Shoulder 22 tapers inwardly from end portion 20 to the remainder of attachment 14 and provides a stop which prohibits further insertion of extension member 16 within end portion 20. Arcuately-shaped attachment 14 becomes the terminal portion of elongated extension member 16 once the free end of extension member 16 is inserted in tight telescopic engagement within end portion 20 of attachment 14.

Figure 4:
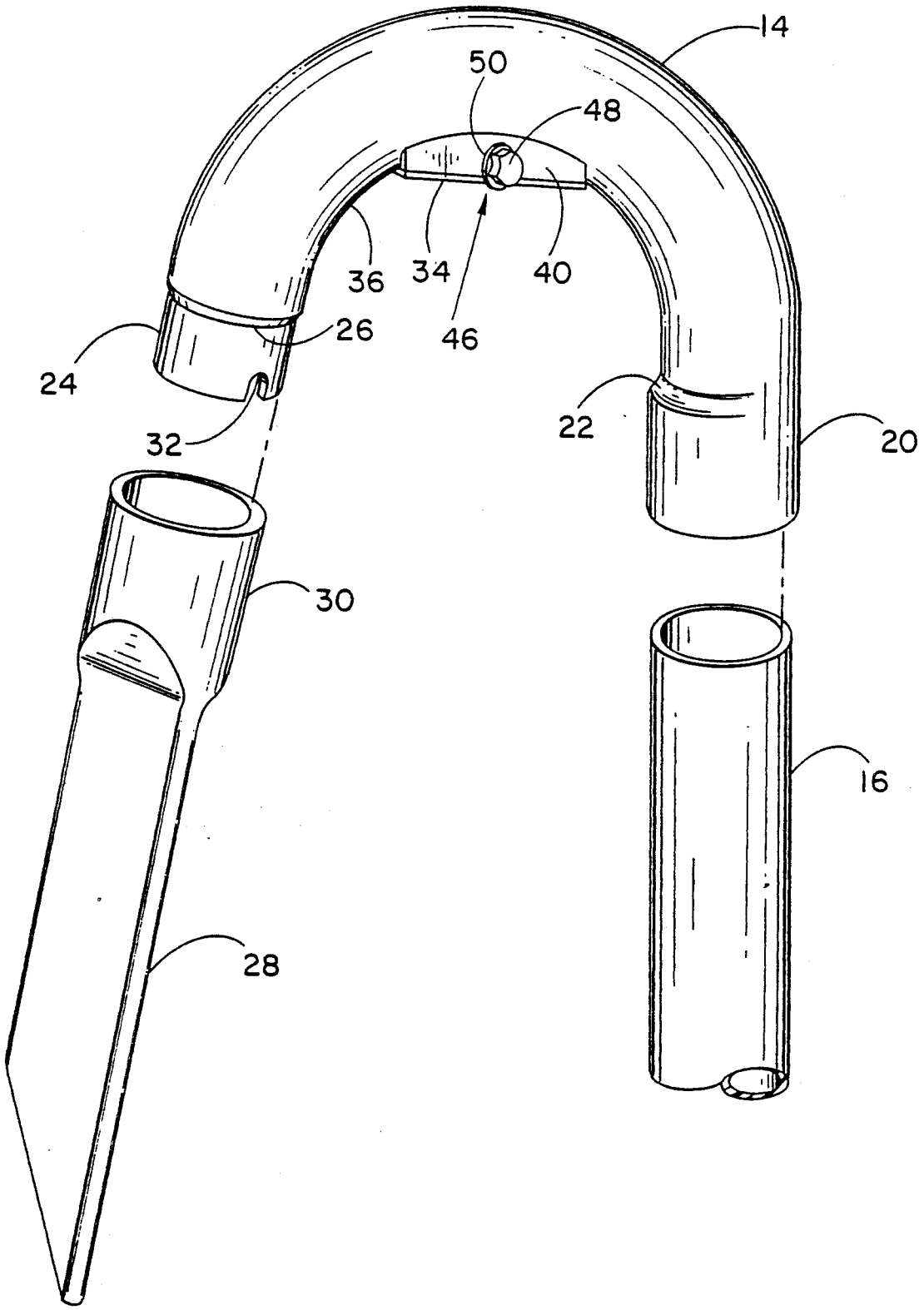
FIG. 4 is a perspective view of my new eave trough cleaning apparatus, showing the reduced end portion thereof which facilitates mounting of various other attachments for aiding in the cleaning of such troughs.

As shown best in FIGS. 2 and 4, the opposite free end 24 of the arcuately-shaped tubular attachment 14 has a reduced external diameter relative to the remainder of the attachment. The free end portion 24 connects to the remainder of attachment 14 via a outwardly tapering annular frustoconically shaped collar 26. Reduced diameter free end portion 24 and collar 26 provide for cooperative fitting of a secondary attachment 28, such as that shown in FIG. 4. Connecting portion 30 of attachment 28 has an inner diameter which is only slightly larger than the external diameter of free end portion 24 and is constructed to engage the free end portion 24 in tight telescopic engagement, if the secondary attachment 28 is needed. Free end portion 24 also includes axial slits 32 which help prevent end portion 24 from becoming clogged or stuck to the bottom of the trough due to the suction created by the vacuuming system 18. Although attachment 28 is shown in FIG. 4, other various attachments may also be used in conjunction with my new eave trough cleaning apparatus 10.

Arcuately-shaped tubular member 14 is constructed with suitable dimensions and curvature so as to provide for easy cleaning of the eave troughs of a home or building from ground level. The curvature of attachment 14 between end 20 and free end 24 thereof is preferably in the range of 150–170 degrees. The optimum curvature of attachment 14 for best operating conditions has been found to be approximately 155 degrees.

Although the above range of curvatures is preferred, curvatures outside that range are possible, but make it more difficult and strenuous for the person operating the eave trough cleaning apparatus 10. If the curvature of attachment 14 is too small, the person operating the cleaning apparatus 10 will be required to raise their arms further in order to position free end 24 of attachment 14 adjacent the inner bottom surface of eave trough 15. If the curvature of attachment 14 is too great, free end 24 of attachment 14 will abut the bottom surface of eave trough 15 at too low of an angle, thereby possibly causing attachment 14 to become stuck thereto as a result of the suction of vacuuming system 18.

Figure 3:
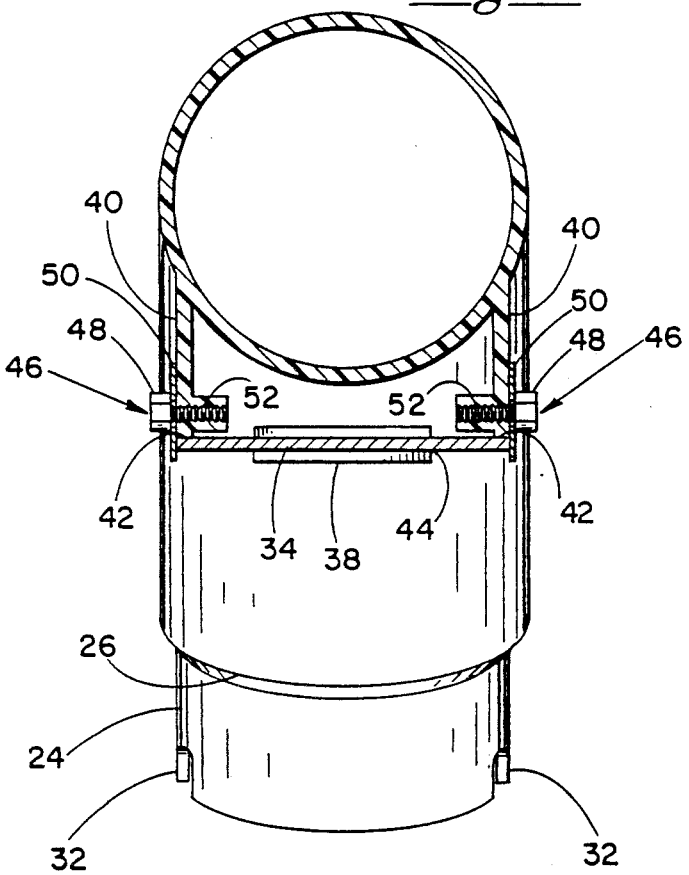
FIG. 3 shows a vertical sectional view taken along lines 3—3 of FIG. 2, showing the construction of the mounting clip and clamps which hold a mirror on the intrados surface of the arcuate terminal portion of my new eave trough cleaning apparatus.

As best shown in FIGS. 2 and 3, a mirror 34 is mounted on the intrados surface 36 of arcuately-shaped tubular member 14. Mirror 34 is mounted with its reflective surface facing the general direction in which the arcuately-shaped attachment 14 opens. The mirror 34 is mounted such that the person operating the eave trough cleaning system 10 may readily view the inner bottom surface of the eave trough 15 which has just been cleaned by suction of the debris therein through the free end 24 of attachment 14. Mirror 34 is shown as being substantially flat in FIG. 2, but it is conceivable that a curved mirror could also be mounted on the intrados surface 36 of attachment 14. As shown in FIG. 2, mirror 34 is mounted in a plane generally normal to the longitudinal axis of extension member 16, thereby reflecting the bottom surface of eave trough 15 in the general direction parallel with the axis of extension member 16, where the operator of the eave trough cleaning system 10 is likely to be standing.

Mirror 34 is held in place by a pair of clips or channel members 38, and side clamps 40. Mirror 34 is constructed so as to be slid within channel clips 38, which are connected to the intrados surface of attachment 14, and preferably integrally formed therewith. Clips 38 provide the main support for mirror 34, and clamps 40 prevent the mirror from moving sideways and slipping out of clips 38.

Clamps 40 are also connected to attachment 14, and are also preferably integrally formed therewith. As shown in FIGS. 2 and 3, each clamp 40 extends from attachment 14 downwardly and terminates at end 42 just short of the horizontal plane extending through channels 44 of channel clips 38. Thus, clamps 40 do not obstruct or prohibit slidable engagement of the mirror 34 within channel clips 38. Each clamp 40 is provided with a securing means 46 for preventing sideways movement of the mirror once the mirror is mounted within channel clips 38. As shown in FIG. 3, securing means 46 comprises bolts 48 and washers 50, which secure to clamps 40 within threaded bores 52. Washers 50 extend downwardly past the edges of the mirror 34 and prevent any sideways movement thereof.

Arcuately-shaped attachment 14 is constructed with dimensions to provide sufficient clearance between free end 24 and mirror 34, such that the mirror 34 will be disposed above the eave trough 15 a sufficient distance to allow the operator to readily view the inner bottom surface thereof. Thus, upon insertion of free end 24 of attachment 14 within the eave trough 15 such that free end 24 is adjacent the trough's inner bottom surface, the mirror 34 will be disposed above the top of the trough a sufficient distance to allow adequate viewing thereof by the operator who is standing on ground level. The diameter of tubular attachment 14 is also constructed of suitable dimensions such that it is easily received within a standard sized eave trough 15, with adequate clearance being provided on each side so as to prevent attachment 14 from becoming lodged therewithin.

As can be seen best from FIG. 1, in operation, the person operating my new eave trough cleaning apparatus connects the arcuately-shaped tubular member 14 to the free end of extension member 16, which is connected to vacuum system 18 to provide suction therethrough. The operator 12 can then raise the extension member 16 up to eave trough 15 from ground level and insert the free end 24 of the arcuate attachment 14 within the eave trough 15. Through use of the combinational wet/dry vacuum 18, the debris within the eave trough will be drawn through attachment 14 and extension member 16 into the holding basin of vacuum 18. As the operator 12 cleans the eave trough, the bottom inner surface of the eave trough 15 can be readily viewed by the operator through use of mirror 34 mounted on the intrados surface 36 of attachment 14. Thus, the operator can effectively ensure that all of the debris in the eave trough 15 is removed therefrom. By use of my new eave trough cleaning apparatus, the eave troughs of a home or building can be cleaned effectively from ground level without the need for climbing a ladder, and without the need for subsequently cleaning the ground therebelow, or the roof thereabove.

In considering the instant invention, of course, it should be understood that various changes may be made in the form, details, arrangement and proportions of the parts thereof without departing from the scope of the invention which consists of the matter shown and described herein and set forth in the appended claims.

What is claimed is:

1. An eave trough cleaning apparatus which can be operated by a person from ground level, comprising:

(a) an elongated at least semi-rigid tubular member having an arcuately-shaped terminal portion with a free end, and an opposite end which is constructed and arranged to sealably connect to a suction means which draws from said tubular member, said tubular member being of suitable length to allow the operator of the cleaning apparatus to reach the eave trough from ground level and insert said free end of said tubular member into the trough;

(b) a mirror mounted on the intrados surface of said arcuate terminal portion of said tubular member, said mirror being mounted such that the reflection surface of said mirror is disposed in a general plane which is substantially normal to the longitudinal axis of said elongated member, thereby enabling the operator of the cleaning apparatus to view the cleaned portion of the inner bottom surface of the eave trough when said free end of said terminal portion is inserted into the eave trough; and (c) said arcuate terminal portion being constructed of suitable dimensions and curvature to facilitate insertion of its free end into the eave trough of a building when standing at ground level.

2. The structure defined in claim 1, including a pair of channel members connected to the intrados surface of said arcuate terminal portion and constructed and arranged to slidably receive and carry said mirror, said mirror being held within said channel members by a clamping means which is connected to said tubular member.

3. The structure defined in claim 1, wherein said arcuate terminal portion of said elongated tubular member has a curvature of approximately 155 degrees.

4. The structure defined in claim 1, wherein said arcuate free end portion of said elongated tubular member has a degree of curvature in the approximate range of 150 to 170.

5. The structure defined in claim 1, including at least one support member connected to said arcuate terminal portion of said tubular member and disposed between said arcuate terminal portion and said mirror, said support member being constructed and arranged to provide a base upon which said mirror can be mounted.

6. The structure defined in claim 1, wherein said free end of said tubular member tapers to a smaller diameter than the remainder of said tubular member.

7. The structure defined in claim 1, wherein said free end of said tubular member has at least one axially extending slit therein.

8. The structure defined in claim 1, wherein said arcuate terminal portion is detachable from said tubular member.

9. A cleaning apparatus attachment for cleaning the eave troughs of a building from ground level which is to be used in conjunction with an elongated and at least semi-rigid extension member that is connected to a suction device which creates a suction therethrough, comprising:

(a) an arcuately-shaped and at least semi-rigid tubular member having a pair of ends, one of said ends being freely disposed and said other end being constructed and arranged to telescopically connect to the elongated extension member of the suction device so as to create a suction through said arcuate tubular member, said arcuate tubular member being of suitable dimensions and curvature to facilitate insertion of said free end into the eave trough; and (b) a mirror mounted on the inner circumferential surface of said arcuate tubular member, said mirror being constructed and arranged to facilitate viewing of the cleaned portion of the inner bottom surface of the trough by the operator of the cleaning apparatus when said arcuate tubular member is connected to the extension member and said free end of said arcuate tubular member is inserted into the eave trough for cleaning thereof, said mirror having a reflective surface which is disposed in a general plane which is substantially parallel to a plane traversing said end of said arcuate tubular member which connects to the elongated extension member.

10. The structure defined in claim 9, wherein said arcuately-shaped tubular member has a curvature between said ends of approximately 155 degrees.

11. The structure defined in claim 10, wherein said arcuately-shaped tubular member is constructed of a substantially rigid plastic material.

12. The structure defined in claim 10, wherein said free end of said arcuately-shaped tubular member has a reduced diameter relative to the diameter of the remainder of the same.

13. The structure defined in claim 10, wherein the free end of said arcuately-shaped tubular member has at least one axially extending slit thereon.

14. The structure defined in claim 10, including a support member connected to said arcuate tubular member and disposed in supporting relation to said mirror.

15. The structure defined in claim 10, wherein said mirror is substantially flat and traverses the arc of the intrados surface of said arcuate tubular member, said mirror being disposed at approximately the halfway point between said ends of said arcuate tubular member, said reflective surface facing the general direction in which said arcuate tubular member opens.

16. The structure defined in claim 10, wherein the curvature of said arcuate tubular member is in the approximate range of 150 to 170 degrees.

17. An eave trough cleaning apparatus, comprising:

(a) an elongated at least semi-rigid tubular member having an arcuately-shaped terminal portion with a free end, and an opposite end which is constructed and arranged to sealably connect to a suction means which draws from said tubular member, said tubular member being of suitable length to allow the operator of the cleaning apparatus to reach the eave trough from ground level and insert said free end of said tubular member into the trough;

(b) a mirror mounted on the intrados surface of said arcuately-shaped terminal portion, said mirror being constructed and arranged to facilitate viewing of the cleaned portion of the inner bottom surface of the eave trough by the operator of the cleaning apparatus during the cleaning thereof, said mirror being mounted with its reflective surface disposed in a general plane which is substantially normal to the longitudinal axis of said elongated tubular member; and (c) said arcuately-shaped portion being constructed with a curvature in the approximate range of 150 to 170 degrees and with suitable dimensions to facilitate insertion thereof into the eave trough for cleaning thereof.

18. The structure defined in claim 17, wherein the curvature of said free end portion is approximately 155 degrees.

19. The structure defined in claim 17, including a mirror and a pair of channel members, said channel members being connected to the intrados surface of said arcuate terminal portion and constructed and arranged to slidably receive and carry said mirror, said mirror being held within said channel members by a clamping means which is connected to said tubular member.

* * * * *